US008519831B2

(12) United States Patent
Chuang et al.

(10) Patent No.: US 8,519,831 B2
(45) Date of Patent: Aug. 27, 2013

(54) REMOTE CONTROL DEVICE AND RECOGNITION METHOD THEREOF

(75) Inventors: Ko-Chien Chuang, Taipei (TW); Albert Chia-Che Young, Taipei County (TW); Wei-Tsun Lee, Taipei County (TW); Ching-Hui Chiu, Taoyuan County (TW)

(73) Assignee: Quanta Computer Inc., Tao Yuan Shien (TW)

( * ) Notice: Subject to any disclaimer, the term of this patent is extended or adjusted under 35 U.S.C. 154(b) by 478 days.

(21) Appl. No.: 12/872,987

(22) Filed: Aug. 31, 2010

(65) Prior Publication Data

US 2011/0084817 A1 Apr. 14, 2011

(30) Foreign Application Priority Data

Oct. 8, 2009 (TW) ..... 98134185 A

(51) Int. Cl.
*G08C 19/00* (2006.01)

(52) U.S. Cl.
USPC ..... 340/12.22; 340/12.3; 340/687; 348/734

(58) Field of Classification Search
USPC ..... 340/825.69, 12.3, 687; 348/734
See application file for complete search history.

(56) References Cited

U.S. PATENT DOCUMENTS

| | | | | |
|---|---|---|---|---|
| 8,228,293 | B2 * | 7/2012 | Dohta et al. | 345/158 |
| 2006/0256082 | A1 * | 11/2006 | Cho et al. | 345/156 |
| 2007/0275755 | A1 * | 11/2007 | Chae et al. | 455/557 |
| 2009/0203445 | A1 | 8/2009 | Dohta et al. | |

* cited by examiner

*Primary Examiner* — Brian Zimmerman
*Assistant Examiner* — Bhavin M Patel
(74) *Attorney, Agent, or Firm* — Rabin & Berdo, P.C.

(57) ABSTRACT

A remote control device and a recognition method thereof. The recognition method is adapted to the remote control device for generating a corresponding remote control signal to control an electronic device when the remote control device is moved. A sequence of sensing signal corresponding to movement of the remote control device is provided. The sequence of sensing signal is converted into a sequence of characteristic data. A sequential predetermined data matching the sequence of characteristic data is selected from a plurality of sequential predetermined data respectively corresponding to a respective remote control signal. The remote control signal corresponding to the matched sequential predetermined data is transmitted to the electronic device.

12 Claims, 4 Drawing Sheets

REMOTE CONTROL DEVICE AND RECOGNITION METHOD THEREOF

This application claims the benefit of Taiwan application Serial No. 98134185, filed Oct. 8, 2009, the subject matter of which is incorporated herein by reference.

BACKGROUND OF THE DISCLOSURE

1. Field of the Disclosure

The disclosure relates in general to a remote control device and a recognition method thereof, and more particularly to a remote control device which outputs a corresponding remote control signal by recognizing the meaning of movement of the remote control device and a recognition method thereof.

2. Description of the Related Art

With the rapid advance in science and technology, many remote control devices adapted to man-machine interactions are provided. The remote control devices can generate corresponding remote control signals based on movement by users to control the electronic device. Examples of the electronic device include game station, multi-media AV device, TV and video recorder.

Despite it is convenient to remotely control the electronic device by moving the remote control device, the conventional remote control device is often negatively affected by mechanical errors (such as the sensing errors of the remote control device) or noise generated when the remote control device is moved. In addition, the conventional remote control device cannot recognize the meaning of the movement shaped as a number or a text. For example, when the user moves the conventional remote control device to draw a number "3", the conventional remote control device can only detects a continuous movement, which in turns converted to a sequence of sensing signals, but cannot recognize what the sequence of sensing signals stands for (the number "3"). Therefore, the conventional remote control device does not generate a remote control signal corresponding to the number "3" to the electronic device to perform the specific function, such as switching to channel 3. To the contrary, the user is limited to move the remove control device along a predetermined and simple direction, and then the conventional remote control device generates the remote control signal corresponding to the direction. For example, the rightward movement denotes increasing the sound volume, the leftward movement denotes decreasing the sound volume, the upward movement denotes switching to the previous channel, and the downward movement denotes switching to the next channel. Thus, the conventional remote control device is not user-friendly in use.

SUMMARY OF THE DISCLOSURE

Examples of the disclosure are directed to a remote control device and a recognition method thereof. The remote control device includes a sensing unit. The remote control device filters a sequence of sensing signal provided by the sensing unit to reduce noise when the remote control device is moved. That is, the remote control device reduces the errors corresponding to the sensing signal, so as to obtain a sequence of characteristic data with better recognition level and generate a corresponding control signal for generating a remote control signal capable of remotely controlling the electronic device.

According to a first example of the present disclosure, a remote control device is provided. The remote control device includes a communication unit, a storing unit, a sensing unit and a processing unit. The storing unit is for storing a plurality of sequential predetermined data respectively corresponding to a respective remote control signal. The sensing unit provides a sequence of sensing signal corresponding to movement of the remote control device. The processing unit converts the sequence of sensing signal into a sequence of characteristic data. A sequential predetermined data matching the sequence of characteristic data is selected from a plurality of sequential predetermined data. The communication unit transmits the remote control signal corresponding to the matched sequential predetermined data.

According to a second example of the present disclosure, a recognition method adapted to a remote control device is provided for generating a corresponding remote control signal to control the electronic device when the remote control device is moved. Provided is a sequence of sensing signal corresponding to movement of the remote control device. The sequence of sensing signal is converted into a sequence of characteristic data. A sequential predetermined data matching the sequence of characteristic data is selected from a plurality of sequential predetermined data respectively corresponding to a respective remote control signal. The remote control signal corresponding to the matched sequential predetermined data is transmitted to the electronic device.

The disclosure will become apparent from the following detailed description of the preferred but non-limiting embodiments. The following description is made with reference to the accompanying drawings.

DETAILED DESCRIPTION OF THE DISCLOSURE

Figure 1:
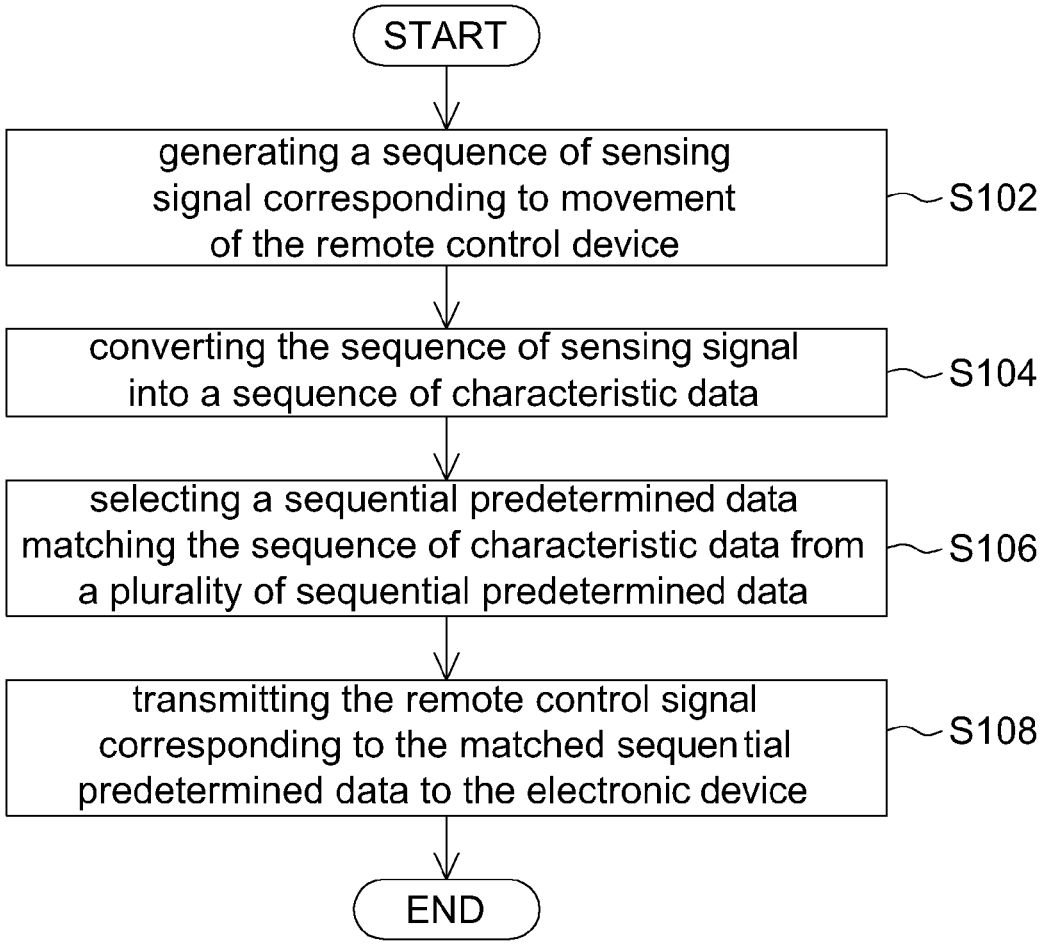
FIG. 1 shows a flowchart for a recognition method according to an embodiment of the disclosure.

Referring to FIG. 1, a flowchart for a recognition method according to an embodiment of the disclosure is shown. The method is adapted to a remote control device for generating a remote control signal corresponding to the movement of the remote control device.

At step S102, a sequence of sensing signal corresponding to the movement of the remote control device is generated. In step S104, the sequence of sensing signal is converted into a sequence of characteristic data. In step S106, a sequential predetermined data having the highest matching rate with the sequence of characteristic data is determined from a plurality of sequential predetermined data. In step S108, the remote control signal corresponding to the matched sequential predetermined data is transmitted.

Figure 2:
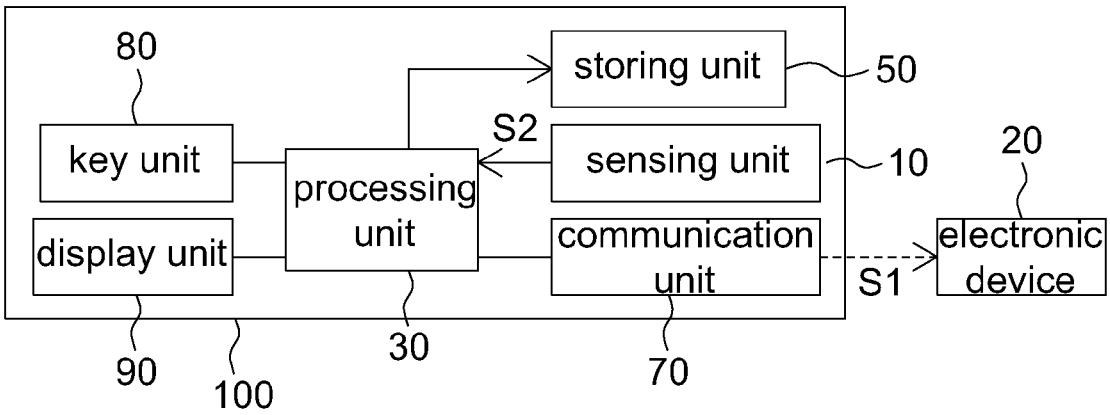
FIG. 2 shows a block diagram of a remote control device implementing the recognition method of FIG. 1.
Figure 3:
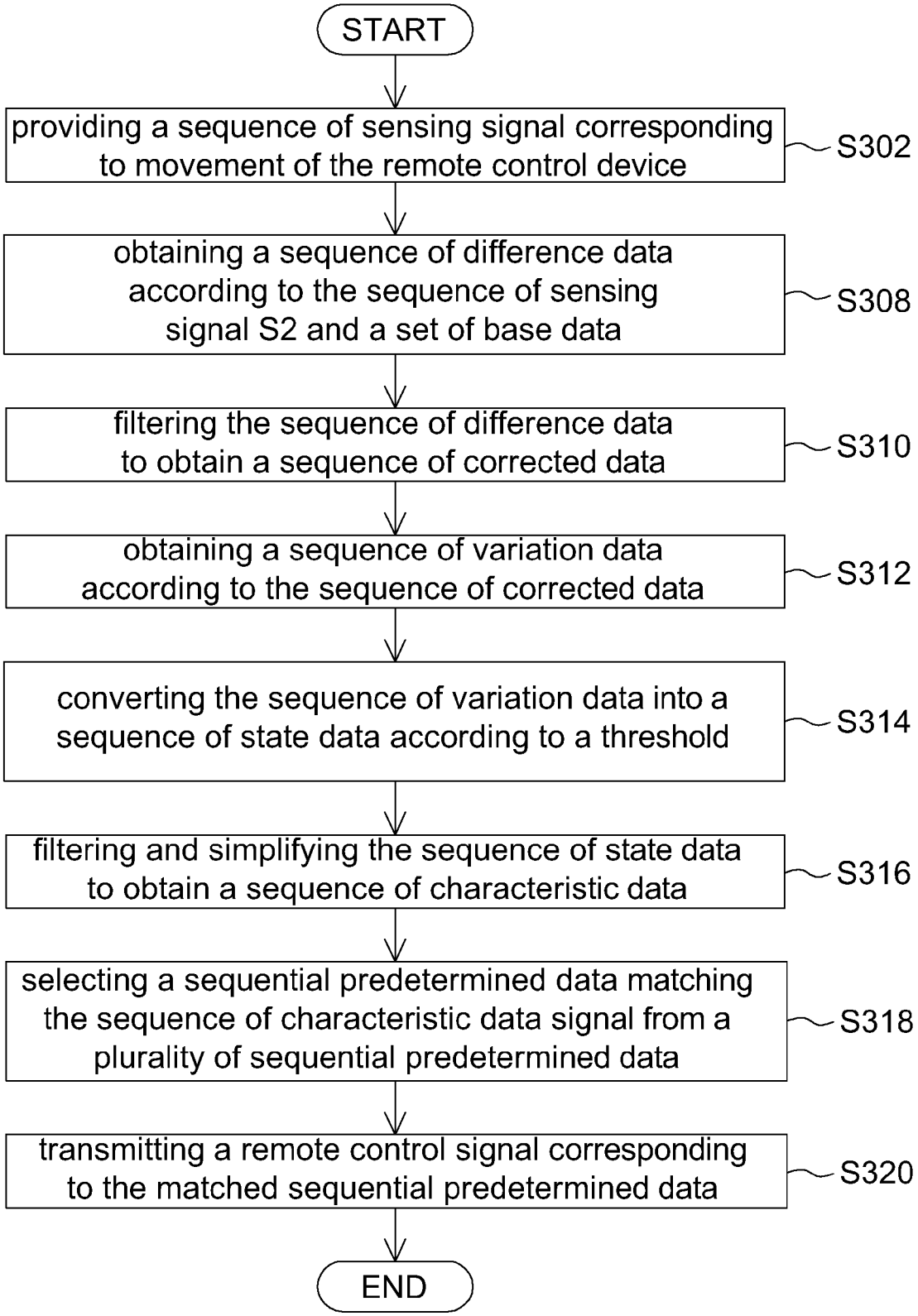
FIG. 3 shows a detailed flowchart according to the recognition method of FIG. 1.

Referring to FIG. 2 and FIG. 3. FIG. 2 shows a block diagram of a remote control device implementing the recognition method of FIG. 1. FIG. 3 shows a detailed flowchart according to the recognition method of FIG. 1. However, anyone who is skilled in the art will understand that the remote control method is not limited to be used in the remote control device of FIG. 2, and steps and orders in the recognition method can be modified or adjusted according to actual needs.

In FIG. 2, the remote control device 100 could generate a corresponding remote control signal S1 when the remote control device 100 is moved, and the remote control signal S1 is adapted to an electronic device 20 capable of receiving the remote control signal S1. Examples of the remote control device 100 include game station controller or portable electronic device (such as personal digital assistant (PDA) or mobile phone). Examples of the electronic device 20 include game station, multi-media AV device, TV, video recorder or devices to which the remote control device 100 is adapted.

The remote control device 100 includes a sensing unit 10, a processing unit 30, a storing unit 50, a communication unit 70, a key unit 80 and a display unit 90. The sensing unit 10 is used to generate a sequence of sensing signal S2 corresponding to the movement of the remote control device 100. For example, the sensing unit 10 generates a sequence of acceleration values or a sequence of speed values corresponding to the movement. In the present embodiment of the disclosure, the sequence of sensing signals S2 generated by the sensing unit 10 corresponds to the sequence of acceleration values. In addition, the key unit 80 and the display unit 90 are optional according to actual needs. The storing unit 50 is used to store a plurality of sequential predetermined data for recognition purpose and store the sequence of sensing signals S2. In a practical embodiment, the storing unit 50 is such as an in-built memory or an external memory card.

The detailed method is disclosed with reference to FIG. 3. At step S302, the sensing unit 10 provides a sequence of sensing signal S2 corresponding to the movement of the remote control device 100 and stores the sequence of sensing signal S2 in the storing unit 50. In a practical embodiment, the sequence of sensing signal S2 includes 3 sub-sequences of sensing signal $X_{raw}$ (t), $Y_{raw}$ (t) and $Z_{raw}$ (t) respectively correspond to the 3D spatial axes.

In step S308, 3 sequences of difference data $X_{dif}$(t), $Y_{dif}$(t) and $Z_{dif}$(t) are obtained according to the sequence of sensing signal S2 and a set of base data $X_{base}$, $Y_{base}$ and $Z_{base}$. The set of base data is obtained by performing low-pass filtering on the sequence of sensing signal S2 when the remote control device 100 is in an idle state (the speed thereof is 0). The set of base data $X_{base}$, $Y_{base}$ and $Z_{base}$ is regarded as a reference for determining whether the remote control device 100 moves. If at least one of the 3 sub-sequences of the sensing signal $X_{raw}$ (t), $Y_{raw}$ (t) and $Z_{raw}$ (t) of the sequence of sensing signal S2 differs from the corresponding base data $X_{base}$, $Y_{base}$ and $Z_{base}$, it is determined that the remote control device 100 is in a moving state, and then the sequence of sensing signals S2 can further be processed and analyzed. The set of base data $X_{base}$, $Y_{base}$ and $Z_{base}$ can be expressed in the following formulas:

$$X_{base} = \frac{\sum_{1}^{w} X_{raw}(t)}{w} \text{ idle state;}$$

$$Y_{base} = \frac{\sum_{1}^{w} Y_{raw}(t)}{w} \text{ idle state;}$$

-continued $$Z_{base} = \frac{\sum_{1}^{w} Z_{raw}(t)}{w} \text{ idle state;}$$

w is a natural number. Due to that the 3 sub-sequences of sensing signal $X_{raw}$ (t), $Y_{raw}$ (t) and $Z_{raw}$ (t) would remain constant if the remote control device 100 is in an idle state (the speed is 0), the corresponding 3D base data $X_{base}$, $Y_{base}$ and $Z_{base}$ would also remain constant. In a practical embodiment, the set of base data $X_{base}$, $Y_{base}$ and $Z_{base}$ can be stored in the storing unit 50 in advance.

In step S308, 3 sequences of difference data $X_{dif}$(t), $Y_{dif}$(t) and $Z_{dif}$(t) can be expressed in the following formulas:

$$X_{dif}(t)=X_{base}-X_{raw}(t);$$

$$Y_{dif}(t)=Y_{base}-Y_{raw}(t);$$

$$Z_{dif}(t)=Z_{base}-Z_{raw}(t);$$

It is noted that the sequences of difference data $X_{dif}$(t), $Y_{dif}$ (t) and $Z_{dif}$(t) can also be expressed in the following formulas, and that should be corrected in subsequent steps.

$$X_{dif}(t)=X_{raw}(t)-X_{base};$$

$$Y_{dif}(t)=Y_{raw}(t)-Y_{base};$$

$$Z_{dif}(t)=Z_{raw}(t)-Z_{base};$$

Afterwards, in step S310, the 3 sequences of difference data $X_{dif}$ (t), $Y_{dif}$ (t) and $Z_{dif}$ (t) are respectively filtered to obtain 3 sequences of corrected data $X_{int}$ (t), $Y_{int}$ (t) and $Z_{int}$ (t), respectively. Step S310 is performed for eliminating the interference caused by noises by low-pass filtering. In a practical embodiment, the sequences of corrected data $X_{int}$ (t), $Y_{int}$ (t) and $Z_{int}$ (t) can be expressed in the following formulas:

$$X_{int}(t) = \frac{\sum_{t}^{w+t} X_{dif}(t)}{w};$$

$$Y_{int}(t) = \frac{\sum_{t}^{w+t} Y_{dif}(t)}{w};$$

$$Z_{int}(t) = \frac{\sum_{t}^{w+t} Z_{dif}(t)}{w};$$

Figure 4A:
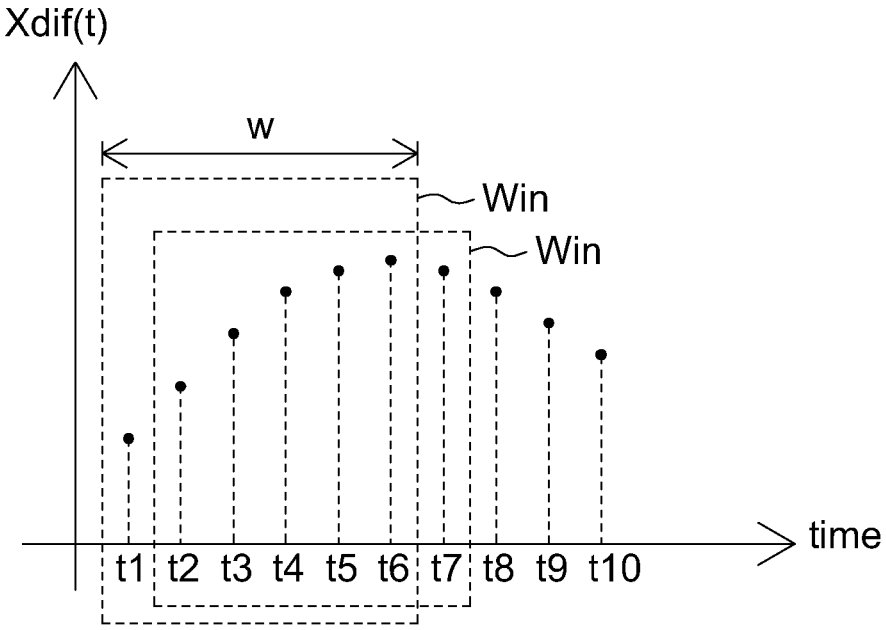
FIG. 4A shows an example of the sliding window in the step S310 of FIG. 3.

For detailed elaboration, please referring to FIG. 4A. The sequences of corrected data $X_{int}$ (t), $Y_{int}$ (t) and $Z_{int}$ (t) may be obtained in the same or similar way, FIG. 4A is exemplified by the sequence of corrected data $X_{int}$ (t).

The processing unit 30 uses a sliding window Win accommodated to w data to perform the low-pass filtering, wherein the data of the sequence of difference data $X_{dif}$ (t) in the sliding window would be accumulated and then averaged. Then, the sliding window Win shifts rightwards for a time unit (i.e. corresponding to a sampling rate or next data), and the above step is performed again, so as to obtain the low-pass filtered sequence of corrected data $X_{int}$ (t). For example, assuming that the sequence of difference data $X_{dif}$(t) is: $X_{dif}$ (t1)=3; $X_{dif}$(t2)=6; $X_{dif}$(t3)=9; $X_{dif}$(t4)=12; $X_{dif}$(t5)=15; $X_{dif}$ (t6)=15; $X_{dif}$ (t7)=15; $X_{dif}$ (t8)=12; $X_{dif}$ (t9)=9; $X_{dif}$ (t10)= 6 . . . , then based on the above description, the sequence of corrected data $X_{int}$ (t) is expressed as: $X_{int}$ (t1)=3; $X_{int}$ (t2)=4.5; $X_{int}$ (t3)=6; $X_{int}$ (t4)=30/4=7.5; $X_{int}$ (t5)=45/5=9; $X_{int}$ (t6)=60/6=10 . . . , and so on. In a practical embodiment, w is 6.

Figure 4B:
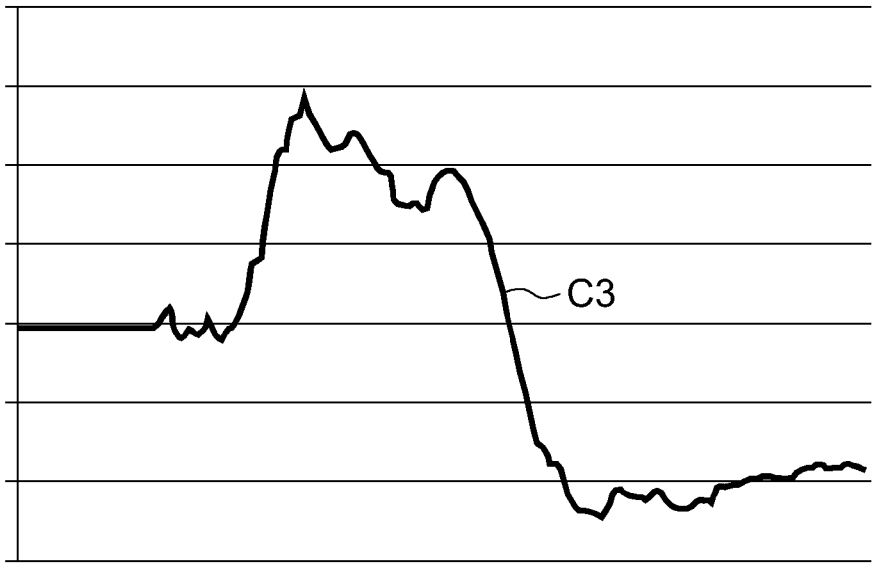
FIG. 4B shows an example of a sequence of difference data in the step S310 of FIG. 3.
Figure 4C:
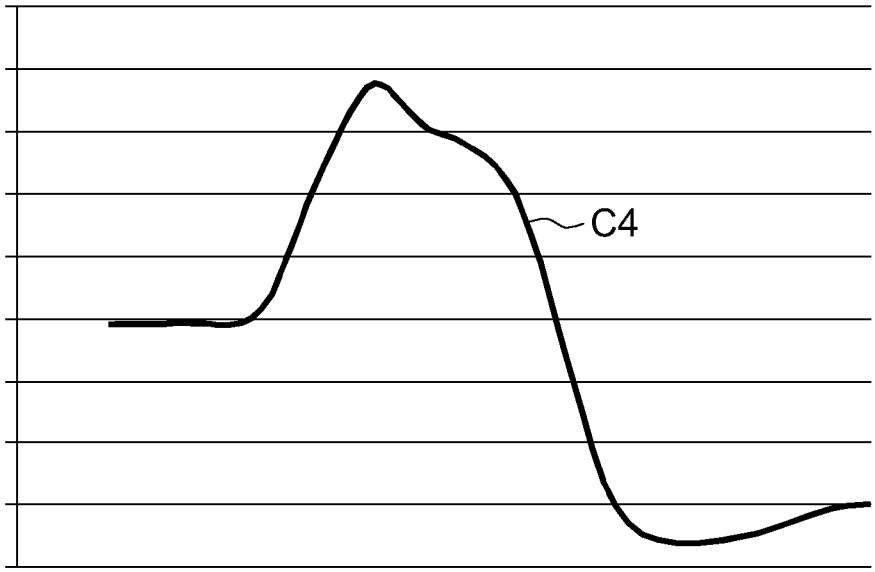
FIG. 4C shows an example of a sequence of corrected data in the step S310 of FIG. 3.

Referring to FIG. 4B and FIG. 4C. The curve C3 represents the sequence of difference data $X_{dif}$ (t), and the curve C4 represents the sequence of corrected data $X_{int}$ (t). The curve C4 is smoother than the curve C3. That is, the processing unit 30 filters noises through the sliding window Win to improve recognizability, so to enhance the recognition efficiency of the remote control device 100.

In step S312, the processing unit 30 obtains the sequences of variation data $V_X$ (t), $V_Y$ (t) and $V_Z$ (t) according to the sequences of corrected data $X_{int}$ (t), $Y_{int}$ (t) and $Z_{int}$ (t) and a plurality of specific forcing data $X_{1g}$, $Y_{1g}$, $Z_{1g}$, $X_{0g}$, $Y_{0g}$, $Z_{0g}$. In a practical embodiment, the sequences of variation data $V_X$ (t), $V_Y$ (t) and $V_Z$ (t) can be expressed in the following formulas:

$$V_X(t) = \frac{X_{int}(t)}{X_{1g} - X_{0g}};$$

$$V_Y(t) = \frac{Y_{int}(t)}{Y_{1g} - Y_{0g}};$$

$$V_Z(t) = \frac{Z_{int}(t)}{Z_{1g} - Z_{0g}};$$

$X_{1g}$, $Y_{1g}$, $Z_{1g}$ respectively denote the 3 sub-sequences of sensing signals $X_{raw}$ (t), $Y_{raw}$ (t) and $Z_{raw}$ (t)$X_{ra}$, (t) while the sensing unit 10 is subjected to 1 gravitational acceleration (1 g=9.8 m/s2); and $X_{0g}$, $Y_{0g}$, $Z_{0g}$ respectively denote the 3 sub-sequences of sensing signals $X_{raw}$ (t), $Y_{raw}$ (t) and $Z_{raw}$ (t) while the sensing unit 10 is free of gravitational acceleration. Likewise, a plurality of specific forcing data $X_{1g}$, $Y_{1g}$, $Z_{1g}$, $X_{0g}$, $Y_{0g}$, $Z_{0g}$ are constant, and can be measured and stored in the storing unit 50 in advance.

In step S314, the processing unit 30 converts the sequences of variation data $V_X$ (t), $V_Y$ (t) and $V_Z$ (t) into a sequence of state data according to a threshold. Table 1 is a reference table showing the sequences of variation data $V_X$ (t), $V_Y$ (t) and $V_Z$ (t), the threshold and the corresponding state. In practical application, the threshold is such as 0.3.

| State | Variation Data $V_X$ (t) | Variation Data $V_Y$ (t) | Variation Data $V_Z$ (t) |
|---|---|---|---|
| 1 | $V_X$ > Threshold | $V_Y$ > Threshold | $V_Z$ > Threshold |
| 2 | $\|V_X\|$ < Threshold | $V_Y$ > Threshold | $V_Z$ > Threshold |
| 3 | $V_X$ < Threshold | $V_Y$ > Threshold | $V_Z$ > Threshold |
| 4 | $V_X$ < Threshold | $\|V_Y\|$ < Threshold | $V_Z$ > Threshold |
| 5 | $V_X$ < Threshold | $V_Y$ < Threshold | $V_Z$ > Threshold |
| 6 | $\|V_X\|$ < Threshold | $V_Y$ < Threshold | $V_Z$ > Threshold |
| 7 | $V_X$ > Threshold | $V_Y$ < Threshold | $V_Z$ > Threshold |
| 8 | $V_X$ > Threshold | $\|V_Y\|$ < Threshold | $V_Z$ > Threshold |
| 9 | $V_X$ > Threshold | $V_Y$ > Threshold | $\|V_Z\|$ < Threshold |
| 10 | $\|V_X\|$ < Threshold | $V_Y$ > Threshold | $\|V_Z\|$ < Threshold |
| 11 | $V_X$ < Threshold | $V_Y$ > Threshold | $\|V_Z\|$ < Threshold |
| 12 | $V_X$ < Threshold | $\|V_Y\|$ < Threshold | $\|V_Z\|$ < Threshold |
| 13 | $V_X$ < Threshold | $V_Y$ < Threshold | $\|V_Z\|$ < Threshold |
| 14 | $\|V_X\|$ < Threshold | $V_Y$ < Threshold | $\|V_Z\|$ < Threshold |
| 15 | $V_X$ > Threshold | $V_Y$ < Threshold | $\|V_Z\|$ < Threshold |
| 16 | $V_X$ > Threshold | $\|V_Y\|$ < Threshold | $\|V_Z\|$ < Threshold |
| 17 | $V_X$ > Threshold | $V_Y$ > Threshold | $V_Z$ < Threshold |
| 18 | $\|V_X\|$ < Threshold | $V_Y$ > Threshold | $V_Z$ < Threshold |
| 19 | $V_X$ < Threshold | $V_Y$ > Threshold | $V_Z$ < Threshold |
| 20 | $V_X$ < Threshold | $\|V_Y\|$ < Threshold | $V_Z$ < Threshold |
| 21 | $V_X$ < Threshold | $V_Y$ < Threshold | $V_Z$ < Threshold |
| 22 | $\|V_X\|$ < Threshold | $V_Y$ < Threshold | $V_Z$ < Threshold |

-continued

| State | Variation Data $V_X$ (t) | Variation Data $V_Y$ (t) | Variation Data $V_Z$ (t) |
|---|---|---|---|
| 23 | $V_X$ > Threshold | $V_Y$ < Threshold | $V_Z$ < Threshold |
| 24 | $V_X$ > Threshold | $\|V_Y\|$ < Threshold | $V_Z$ < Threshold |
| 25 | $\|V_X\|$ < Threshold | $\|V_Y\|$ < Threshold | $\|V_Z\|$ < Threshold |
| 26 | $\|V_X\|$ < Threshold | $\|V_Y\|$ < Threshold | $V_Z$ > Threshold |
| 27 | $\|V_X\|$ < Threshold | $\|V_Y\|$ < Threshold | $V_Z$ < Threshold |

Figure 5:
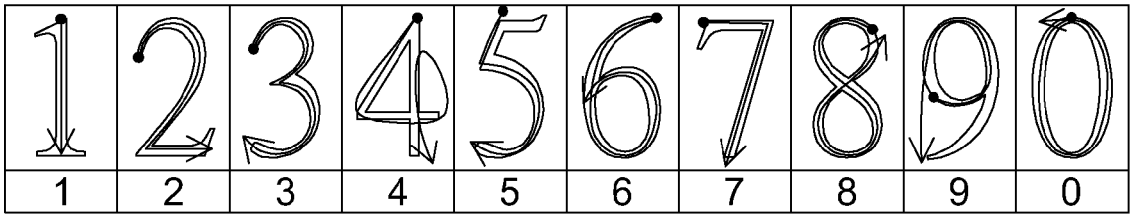
FIG. 5 shows an example of a table showing the relationship between sequential predetermined data and the movement of the remote control device.

Referring to FIG. 5, an example of a table showing the relationship between sequential predetermined data and the movement of the remote control device is provided. Assuming that if a user moves the remote control device 100 following the stroke or arrow direction indicated by "3" of FIG. 5, the processing unit 30 obtains the sequence of state data, according to step S302 to step S314 disclosed above, such as: "3,3,3,3,3,3,3,3,3,2,2,1,1,1,1,1,1,1,1,1,1,9,9,9,17,17,17,17,18,19,19,19,19,19,19,19,19,19,11,11,3,3,3,3,3,3,3,3,2,2,1,1,1,1,1,1,1,1,1,1,9,9,17,17,17,17,17,17,18,19,19,19,19,19,19,19,19,19,19,19,11,12,12,12,12,4,4,4".

In step S316, the processing unit 30 filters and simplifies the sequence of state data to obtain a sequence of characteristic data. For example, the processing unit 30 converts 4 consecutive data having the same state into one characteristic data (for example, 4 consecutive data having state 5 are converted into one characteristic data having state 5), however, the consecutive data with fewer number having the same state are also converted into one characteristic data (for example, 3 consecutive data having the same state 5 is converted into one characteristic data having state 5), so that the sequence of state data are simplified, thus simplifying recognition process and saving recognition time. Based on the above procedures, the sequence of state data can be converted into the sequence of characteristic data as follows: "3,3,3,2,1,1,1,9,17,18,19,19,19,11,3,3,2,1,1,1,9,17,17,18,19,19,19,11,12,4". In other embodiments, data simplification can have other implementation according to actual needs and is not limited to the above exemplification.

In step S318, the processing unit 30 finds and/or selects a sequential predetermined data matching the sequence of characteristic data from a plurality of sequential predetermined data. Each sequential predetermined data corresponds to a respective remote control signal and the plurality of sequential predetermined data could be stored in the storing unit 50.

In a practical embodiment, the sequence of characteristic data is compared with each sequential predetermined data based on the "Longest Common Subsequence" algorithm. For example, a sequence of characteristic data includes data X1~Xi, wherein i denotes the number of the data and a sequential predetermined data stored in the storing unit 50 include data Y1~Yj (j denotes the number of data). Assuming that the sequence of characteristic data include 4 data such as "1,4,3,4" and the sequential predetermined data include 3 data such as "1,4,4". Then, the processing unit 30 obtains a matching rate according to the following formulas:

$$LCS(X_{1 \ldots i}, Y_{1 \ldots j}) = \begin{cases} 0 & \text{if } i = 0 \text{ or } j = 0 \\ LCS(X_{1 \ldots i-1}, Y_{1 \ldots j-1}) & \text{if } Xi = Xj \\ \max(LCS((X_{1 \ldots i-1}, Y_{1 \ldots j-1}), LCS(X_{1 \ldots i-1}, Y_{1 \ldots j-1})) & \text{else;} \end{cases}$$

$$\text{Matching rate} = \frac{LCS_{[i,j]}}{\text{Max}\left(\sum_{1}^{i} 1, \sum_{1}^{j} 1\right)} * 100\%.$$

Thus, the matching rate obtained by the processing unit 30 is 75%.

By repeating the above procedure to all of the sequential predetermined data, the sequential predetermined data having maximum matching rate is determined and defined as the matched sequential predetermined data corresponding to the sequence of characteristic data. To further assure high matching accuracy, the processing unit 30 confirms whether the recognition is successful (i.e. the matched sequential predetermined data is determined) by comparing the matching rate to a matching threshold. That is, if a matching rate is lower than the matching threshold, it is determined that recognition fails. Thus, the processing unit 30 excludes the possibility of the sequential predetermined data, whose matching rate is lower than the matching threshold, to be the matched sequential predetermined data, and then continues to determine next sequential predetermined data. For example, assuming that the matching threshold is 50% and the matching rates of the plurality of sequential predetermined data are 15%, 25%, 45%, 30%, 15% respectively. Because maximum matching rate of the sequential predetermined data is just 45%, lower than the matching threshold (50%), the sequential predetermined data with the maximum matching rate is still excluded. This implies that the recognition for the sequence of characteristic data fails, and this might be caused by noise or an unintentional shift.

In step S320, the processing unit 30 controls the communication unit 70 to transmit a remote control signal S1 corresponding to the matched sequential predetermined data. The processing unit 30 such as controls the communication unit 70 to transmit the remote control signal S1 corresponding to number "3" through a control signal corresponding to number "3". The communication unit 70 such as supports Bluetooth protocol, Infrared Data Association (IrDA) protocol, or Wireless Fidelity (WiFi) protocol. In other embodiments, the remote control device 100 correspondingly selects the communication protocol supported by the communication unit 70 according to the electronic device 20.

Other embodiments of the disclosure may further provide a user-custom function. That is, the user defines which stroke (movement of the remote control device 100) corresponds to a specific remote control signal. For example, the processing unit 30 determines whether the key unit 80 is activated so as to enter the user-custom mode. If the key unit 80 is activated, the processing unit 30 begins to store, in the storing unit 50, a plurality of to-be-defined data converted from a plurality of sequences of sensing signal (sensed by moving remote control device 100 several times, based on the same hand gesture), and then the processing unit 30 selects a to-be-defined data with highest matching rate from the plurality of to-be-defined data to replace one of the sequential predetermined data originally stored in the storing unit 50. Thus, the user could define personal stroke or hand gestures the user like to transmit remote control signals to perform specific functions, hence increasing convenience in use.

In other embodiments, after replacing a sequential predetermined data with a to-be-defined data, the processing unit 30 further controls the display unit 90 to display the replaced result, such as number, text or symbol, corresponding to the movement or stroke of the remote control device 100 to inform the user.

The remote control device and the recognition method thereof disclosed in above embodiments of the disclosure have many effects exemplified below:

(1) Providing direct and user-friendly operations, significantly overcoming the prior drawback in which a particular and unchangeable control signal can only be generated by moving in a particular direction.

(2) Filtering the sensing signal generated by the remote control device in idle state, hence lowering the mechanical error (that is, the sensing error) of the remote control device and increasing the recognition efficiency of the remote control device.

(3) Providing user-defined function according to user's stroke or movement, shape of number, text or symbol, to correspond specific control function, hence increasing the flexibility and convenience in the use of the remote control device.

While the disclosure has been described by way of example and in terms of a preferred embodiment, it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A remote control device, comprising:

a storing unit for storing a plurality of sequential predetermined data respectively correspond to a remote control signal;

a sensing unit for providing a sensing signal sequence corresponding to movement of the remote control device, the sensing signal sequence comprising sub-sensing signals respectively corresponding to 3D spatial axes of the remote control device;

a processing unit for converting the sensing signal sequence into a sequence of characteristic data and selecting a sequential predetermined data matching the sequence of characteristic data from the plurality of sequential predetermined data;

a communication unit for transmitting a remote control signal corresponding to the matched sequential predetermined data;

wherein in converting the sequence of characteristic data, the processing unit obtains a sequence of difference data according to the sensing signal sequence and a set of base data and filters the sequence of difference data to obtain a sequence of corrected data;

wherein after obtaining the sequence of corrected data, the processing unit obtains a sequence of variation data according to the sequence of corrected data and a forcing data and converts the sequence of variation data into a sequence of state data according to a threshold;

wherein the set of base data is the sub-sequences of sensing signals generated if the sensing unit is in idle state; the processing unit obtains the sequence of difference data according to:

$$X_{dif}(t)=X_{base}-X_{raw}(t);$$

$$Y_{dif}(t)=Y_{base}-Y_{raw}(t);$$

$$Z_{dif}(t)=Z_{base}-Z_{raw}(t);$$

$X_{base}$, $Y_{base}$ and $Z_{base}$ respectively denoting the set of base data corresponding to the 3D spatial axes, $X_{dif}$, $Y_{dif}$ and $Z_{dif}$ respectively denoting the sequences of difference data corresponding to the 3D spatial axes, and $X_{raw}$, $Y_{raw}$, $Z_{raw}$ respectively denoting the sub-sequences of sensing signals corresponding to the 3D spatial axes; and wherein the processing unit obtains the sequence of variation data according to:

$$V_X(t)=\frac{X_{int}(t)}{X_{1g}-X_{0g}};$$

$$V_Y(t)=\frac{Y_{int}(t)}{Y_{1g}-Y_{0g}};$$

$$V_Z(t)=\frac{Z_{int}(t)}{Z_{1g}-Z_{0g}},$$

$V_X$, $V_Y$ and $V_Z$ respectively denoting the sequence of variation data corresponding to the 3D spatial axes, $X_{1g}$, $Y_{1g}$, $Z_{1g}$ respectively denoting the forcing data obtained from the sub-sequences of sensing signals corresponding to the 3D spatial axes when the sensing unit is subjected to 1 gravitational acceleration, and $X_{0g}$, $Y_{0g}$, $Z_{0g}$ respectively denoting the forcing data obtained from the sequences of sensing signals corresponding to the 3D spatial axes when the sensing unit is free of gravitational acceleration.

2. The remote control device according to claim 1, wherein the processing unit further filters and simplifies the sequence of state data to obtain the sequence of characteristic data.

3. The remote control device according to claim 1, wherein the processing unit obtains the sequence of corrected data according to:

$$X_{int}(t)=\frac{\sum_{t}^{w+t}X_{dif}(t)}{w};$$

$$Y_{int}(t)=\frac{\sum_{t}^{w+t}Y_{dif}(t)}{w};$$

$$Z_{int}(t)=\frac{\sum_{t}^{w+t}Z_{dif}(t)}{w},$$

$X_{int}$, $Y_{int}$ and $Z_{int}$ respectively denoting the sequence of corrected data corresponding to the 3D spatial axes and w being a natural number.

4. The remote control device according to claim 1, wherein the processing unit obtains the sequence of corrected data according to:

$$X_{int}(t)=\frac{\sum_{t}^{w+t}X_{dif}(t)}{w};$$

$$Y_{int}(t)=\frac{\sum_{t}^{w+t}Y_{dif}(t)}{w};$$

$$Z_{int}(t)=\frac{\sum_{t}^{w+t}Z_{dif}(t)}{w},$$

$X_{int}$, $Y_{int}$ and $Z_{int}$ respectively denoting the sequence of corrected data corresponding to the 3D spatial axes and w being a natural number.

5. The remote control device according to claim 4, wherein the processing unit obtains the sequence of variation data according to:

$$V_X(t)=\frac{X_{int}(t)}{X_{1g}-X_{0g}};$$

$$V_Y(t)=\frac{Y_{int}(t)}{Y_{1g}-Y_{0g}};$$

$$V_Z(t)=\frac{Z_{int}(t)}{Z_{1g}-Z_{0g}},$$

$V_X$, $V_y$ and $V_Z$ respectively denoting the sequence of variation data corresponding to the 3D spatial axes, $X_{1g}$, $Y_{1g}$, $Z_{1g}$ respectively denoting the forcing data obtained from the sub-sequences of sensing signals corresponding to the 3D spatial axes when the sensing unit is subjected to 1 gravitational acceleration, and $X_{0g}$, $Y_{0g}$, $Z_{0g}$ respectively denoting the forcing data obtained from the sub-sequences of sensing signals corresponding to the 3D spatial axes under that the sensing unit is free of gravitational acceleration.

6. The remote control device according to claim 5, wherein the processing unit further filters and simplifies the sequence of state data to obtain the sequence of characteristic data.

7. A recognition method adapted to a remote control device for controlling an electronic device, comprising:

providing a sensing signal sequence corresponding to movement of the remote control device, wherein the sensing signal sequence comprises sub-sensing signals respectively corresponding to 3D spatial axes of the remote control device;

converting the sensing signal sequence into a sequence of characteristic data;

selecting a sequential predetermined data matching the sequence of characteristic data from a plurality of sequential predetermined data respectively corresponding to a remote control signal, respectively;

transmitting the remote control signal corresponding to the matched sequential predetermined data to the electronic device;

obtaining a sequence of difference data according to the sensing signal sequence and a set of base data;

filtering the sequence of difference data to obtain a sequence of corrected data;

obtaining a sequence of variation data according to the sequence of corrected data and a forcing data; and converting the sequence of variation data into a sequence of state data according to a threshold;

wherein the set of base data is the sub-sequences of sensing signals generated if the remote control device is in idle state, and the sequence of difference data is obtained according to:

$$X_{dif}(t)=X_{base}-X_{raw}(t);$$

$$Y_{dif}(t)=Y_{base}-Y_{raw}(t);$$

$$Z_{dif}(t)=Z_{base}-Z_{raw}(t);$$

$X_{base}$, $Y_{base}$ and $Z_{base}$ respectively denote the set of base data corresponding to the 3D spatial axes, $X_{dif}$, $Y_{dif}$ and $Z_{dif}$ respectively denoting the sequence of difference data corresponding to the 3D spatial axes, and $X_{raw}$, $Y_{raw}$, $Z_{raw}$ respectively denoting the sub-sequences of sensing signal corresponding to the 3D spatial axes; and wherein the sequence of variation data is obtained according to:

$$V_X(t)=\frac{X_{int}(t)}{X_{1g}-X_{0g}};$$

$$V_Y(t)=\frac{Y_{int}(t)}{Y_{1g}-Y_{0g}};$$

$$V_Z(t)=\frac{Z_{int}(t)}{Z_{1g}-Z_{0g}},$$

$V_X$, $V_Y$ and $V_Z$ respectively denoting the sequence of variation data corresponding to the 3D spatial axes, $X_{1g}$, $Y_{1g}$, $Z_{1g}$ respectively denoting the forcing data obtained from the sub-sequences of sensing signals corresponding to the 3D spatial axes under that the sensing unit is subjected to 1 gravitational acceleration, and $X_{0g}$, $Y_{0g}$, $Z_{0g}$ respectively denoting the forcing data obtained from the sequences of sensing signal corresponding to the 3D spatial axes under that the sensing unit is free of gravitational acceleration.

8. The recognition method according to claim 7, the method further comprises:

filtering and simplifying the sequence of state data to obtain a sequence of characteristic data.

9. The recognition method according to claim 7, wherein the sequence of corrected data is obtained according to:

$$X_{int}(t)=\frac{\sum_{t}^{w+t}X_{dif}(t)}{w};$$

-continued $$Y_{int}(t)=\frac{\sum_{t}^{w+t}Y_{dif}(t)}{w};$$

$$Z_{int}(t)=\frac{\sum_{t}^{w+t}Z_{dif}(t)}{w},$$

$X_{int}$, $Y_{int}$ and $Z_{int}$ respectively denoting the sequence of corrected data corresponding to the 3D spatial axes and w being a natural number.

10. The recognition method according to claim 1, wherein the sequence of corrected data is obtained according to:

$$X_{int}(t)=\frac{\sum_{t}^{w+t}X_{dif}(t)}{w};$$

$$Y_{int}(t)=\frac{\sum_{t}^{w+t}Y_{dif}(t)}{w};$$

$$Z_{int}(t)=\frac{\sum_{t}^{w+t}Z_{dif}(t)}{w},$$

$X_{int}$, $Y_{int}$ and $Z_{int}$ respectively denoting the sequence of corrected data corresponding to the 3D spatial axes and w being a natural number.

11. The recognition method according to claim 10, wherein the sequence of variation data is obtained according to:

$$V_X(t)=\frac{X_{int}(t)}{X_{1g}-X_{0g}};$$

$$V_Y(t)=\frac{Y_{int}(t)}{Y_{1g}-Y_{0g}};$$

$$V_Z(t)=\frac{Z_{int}(t)}{Z_{1g}-Z_{0g}},$$

$V_X$, $V_Y$ and $V_Z$ respectively denoting the sequence of variation data corresponding to the 3D spatial axes, $X_{1g}$, $Y_{1g}$, $Z_{1g}$ respectively denoting the forcing data obtained from the sub-sequences of sensing signals corresponding to the 3D spatial axes when the sensing unit is subjected to 1 gravitational acceleration, and $X_{0g}$, $Y_{0g}$, $Z_{0g}$ respectively denoting the forcing data obtained from the sub-sequences of sensing signals corresponding to the 3D spatial axes when the sensing unit is free of gravitational acceleration.

12. The recognition method according to claim 11, wherein the method further comprises filtering and simplifying the sequence of state data to obtain the sequence of characteristic data.

* * * * *